US006289645B1

(12) United States Patent
Schmid

(10) Patent No.: US 6,289,645 B1
(45) Date of Patent: Sep. 18, 2001

(54) SHUTTERING ELEMENT

(75) Inventor: René P. Schmid, Oberweningen (CH)

(73) Assignee: Agrar Chemie AG (CH)

( * ) Notice: Subject to any disclaimer, the term of this patent is extended or adjusted under 35 U.S.C. 154(b) by 0 days.

(21) Appl. No.: 09/424,573

(22) PCT Filed: May 7, 1998

(86) PCT No.: PCT/EP98/02690

§ 371 Date: Feb. 1, 2000

§ 102(e) Date: Feb. 1, 2000

(87) PCT Pub. No.: WO98/54424

PCT Pub. Date: Dec. 3, 1998

(30) Foreign Application Priority Data

May 28, 1997 (DE) ..... 197 22 449

(51) Int. Cl.[7] ..... E04B 2/00

(52) U.S. Cl. ..... 52/367; 52/396.02; 52/600; 52/667; 52/584.1; 404/48; 404/68; 403/269

(58) Field of Search ..... 52/318, 396.02, 52/432, 600, 601, 367, 780, 667, 584.1; 404/47, 48, 49, 67, 68; 403/270, 269, 286, 305

(56) References Cited

U.S. PATENT DOCUMENTS

| | | | | |
|---|---|---|---|---|
| 3,267,631 | * | 8/1966 | Hammitt | 52/584.1 |
| 3,530,633 | * | 9/1970 | Scott | 52/584.1 |
| 4,184,297 | * | 1/1980 | Casamayor | 52/202 |
| 4,506,481 | | 3/1985 | Witschi et al. . | |
| 4,804,299 | * | 2/1989 | Forte | 52/600 |
| 4,858,411 | * | 8/1989 | Graham | 52/601 |
| 5,225,661 | * | 7/1993 | Chai | 219/145.22 |
| 5,433,051 | * | 7/1995 | Johansson | 52/367 |
| 5,450,699 | * | 9/1995 | Lee | 52/396.02 |
| 5,595,034 | * | 1/1997 | Krysalka et al. | 52/318 |
| 5,855,808 | * | 1/1999 | DiBerardino | 249/114.1 |
| 5,956,912 | * | 9/1999 | Carter et al. | 52/396.02 |
| 6,026,622 | * | 2/2000 | Schmid | 52/396.02 |

FOREIGN PATENT DOCUMENTS

| | | |
|---|---|---|
| 9301566.6 | 3/1994 | (DE) . |
| 9301565.8 | 7/1994 | (DE) . |
| 0093697 | 5/1983 | (EP) . |

* cited by examiner

*Primary Examiner*—Beth A. Stephan
*Assistant Examiner*—Brian E. Glessner
(74) *Attorney, Agent, or Firm*—Harness, Dickey & Pierce, P.L.C.

(57) ABSTRACT

The invention relates to a shuttering element for separating a concrete section into concrete subsections. The shuttering element is of strip-like form and is adapted widthwise to the thickness of the concrete section. It comprises at least a strip-like shuttering board which is formed from a thin-walled, sheet-like material, with the result that, once the concrete section has been cast, the shuttering board can remain between the cast concrete subsections. The shuttering board preferably has recesses through which reinforcement struts can engage, with the result that the shuttering element according to the invention can be inserted even when reinforcement struts of a reinforcement are required to cross the shuttering element.

2 Claims, 7 Drawing Sheets

SHUTTERING ELEMENT

The invention relates to a concrete form or shuttering element.

Prior to the forming of a concrete section, a shuttering is usually erected and has fluid concrete cast into it in order to form the concrete sections. Such a shuttering is usually made up of shuttering panels which, in most cases, comprise wooden boards. Shuttering panels made of steel, plastic, or aluminum are also known.

Such concrete sections are horizontal floor or ceiling parts or vertical wall parts which each have two mutually parallel, large-surface-area side surfaces and four narrow end surfaces.

In the case of horizontal concrete sections, the floor and ceiling sections, the underside of the concrete section which is to be erected, and the end surfaces thereof, have arranged on them shuttering panels which form a tray-like shuttering. For erecting vertical concrete sections, such as the wall sections, shuttering panels for the two vertical, large-surface-area side surfaces and for the vertical end surfaces are erected. These form a narrow, elongate, box-like shuttering. The shutterings are filled with fluid concrete. Once the concrete has hardened, the concrete section is released by the shuttering being removed.

According to DIN 1045, large-surface-area concrete sections are to be divided up into a plurality of subsections, thus forming, between the subsections, expansion or construction joints which are located at the abutment regions of the subsections.

In order to produce such subsections, in the shuttering or horizontal concrete sections, individual regions are separated off by vertical shuttering panels positioned in the tray-like shuttering.

Herein below, the tray-like shuttering for the horizontal concrete sections and the box-like shuttering for the vertical concrete sections will be covered by the umbrella term "main shuttering" and the shuttering introduced in the main shuttering in order to subdivide the concrete section into concrete subsections will be referred to as "separating shuttering".

For filling a main shuttering subdivided into a plurality of subsections by a separating shuttering, only every second subsection is cast in a first casting operation, with the result that the adjacent subsections are free of concrete. Once the concrete has hardened, the separating shuttering is removed and the free subsections are cast. The first casting operation thus results in a pattern in which the filled and non-filled concrete subsections are arranged in a manner similar to the black and white squares on a chess board.

For setting up a separating shuttering for a reinforced concrete section, the separating shuttering, in the region of crossing reinforcement struts, has to be adapted to the latter. In this case, individual shuttering elements are put together around the reinforcement struts and nailed to one another. Setting up shuttering for reinforced concrete sections thus involves considerable outlay in terms of the work involved. For dismantling the shuttering following the concreting operation, the shuttering elements have to be removed again, the separating-shuttering regions engaging around the reinforcement struts being broken out. The operation of dismantling the shuttering is thus at least as work-intensive as the operation of setting up the shuttering. The task of subdividing reinforced concrete sections into individual concrete subsections is associated with considerable outlay in terms of the work involved since the separating shuttering has to be adapted to the reinforcement and, following the casting operation, has to be disengaged from the reinforcement.

In the case of vertical concrete sections, such a subdivision into a plurality of subsections is not customary since further shuttering boards would have to be fitted in between the opposite shuttering boards of the box-like shuttering and this would involve considerable outlay. For the erection of wall sections, therefore, for the specific production of racks, predetermined-crack joint rails (DE 44 22 648 A1) are inserted, these producing, at certain locations, a specific crack which can be sealed subsequently. This ensures the sealing function of the wall. However, a subdivision into a plurality of concrete subsections is not possible with these predetermined-crack joint rails. A large-surface-area and sealed concrete section can be produced by the provision of predetermined cracks. However, the predetermined cracks on the surface of the concrete sections, rather than forming a rectilinear visible edge, have an irregular progression which is not pleasing to the eye.

The object of the invention is to provide a shuttering element which considerably simplifies the outlay in terms of the work involved for erecting a separating shuttering and which allows the shuttering to be filled quickly with fluid concrete. This object is achieved by a shuttering element having the features of claim 1. Advantageous configurations of the invention are defined in the subclaims.

The shuttering element, according to the invention for separating a concrete section into concrete subsections, is of strip-like form and is adapted widthwise to the thickness of the concrete section. The shuttering element has a shuttering board which is formed from a thin-walled, sheet-like material and, once the concrete subsections have been filled, can remain between the concrete subsections.

The thin-walled, sheet-like design of the shuttering element means that it is not necessary for the shuttering element or the shuttering board to be removed from between the concrete subsections. This renders the work involved during the casting of the fluid concrete considerably easier since all the concrete subsections can be cast at the same time, and the casting of the concrete section as a whole need not be subdivided into two concreting operations. The period of time which is necessary for casting a large-surface-area concrete section can be reduced, by means of the shuttering element according to the invention, to approximately ¼ of the usual period of time necessary for casting the fluid concrete.

In addition, in the case of horizontal concrete sections, it is possible for the top edge of the shuttering element to be used as a stripping edge, once the concrete has been cast, in order for the fluid concrete to be distributed evenly and uniformly by a stripper over the individual concrete subsections. This renders the work involved considerably easier.

In a preferred embodiment, the shuttering element is provided with recesses for reinforcement struts, so that the reinforcement struts can extend through the shuttering element in the region of the recesses, thus achieving a further important advantage of the invention. This shuttering element can be inserted into a main shuttering easily and quickly as a separating shuttering, even if the separating shuttering and reinforcement struts of a reinforcement are to cross, since the shuttering element can be fitter easily and quickly on the reinforcement struts.

The joints formed by the shuttering element according to the invention have an esthetically pleasing rectilinear progression. In particular, if the shuttering element is designed as a triangular strip in its border region adjacent to the visible side of the concrete section, this gives a pleasing joint progression since it is not possible for any concrete bridging to form on the relatively wide edge.

The joint board is preferably provided with one or more functional elements such as an injection channel, an injection tube, an expanding strip or transverse webs, which ensure the sealing of the joint between two concrete subsections separated by the shuttering element according to the invention. The functional elements may be provided individually or in combination on the shuttering element according to the invention.

The invention will be explained in more detail by way of example with reference to the drawing, in which.

Figure 3A:
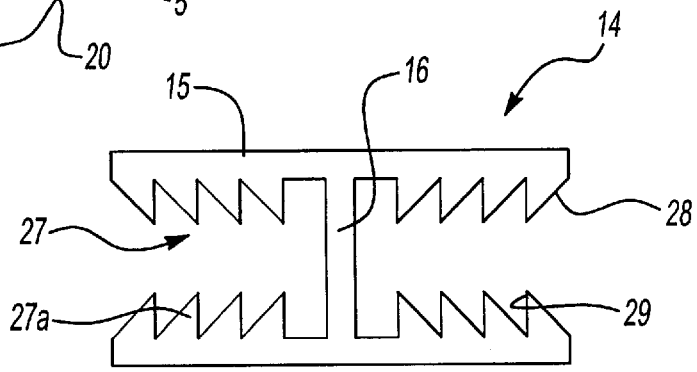
Figure 3B:
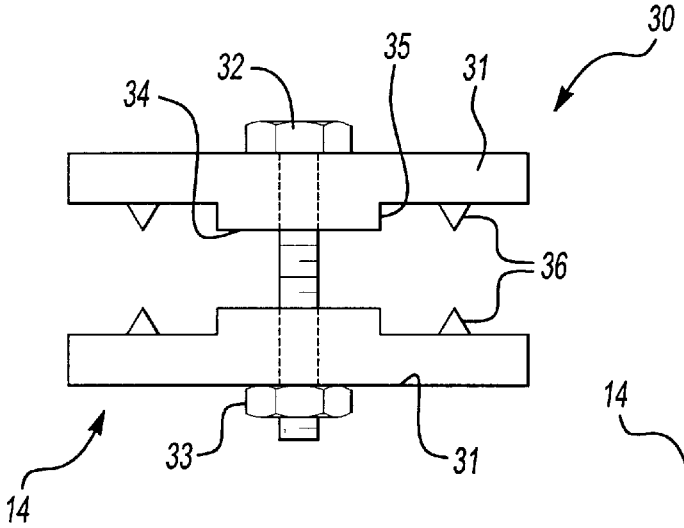
Figure 3C:
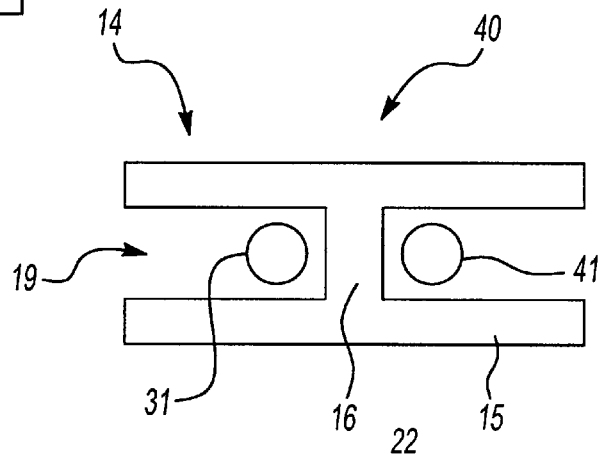
Figure 4:
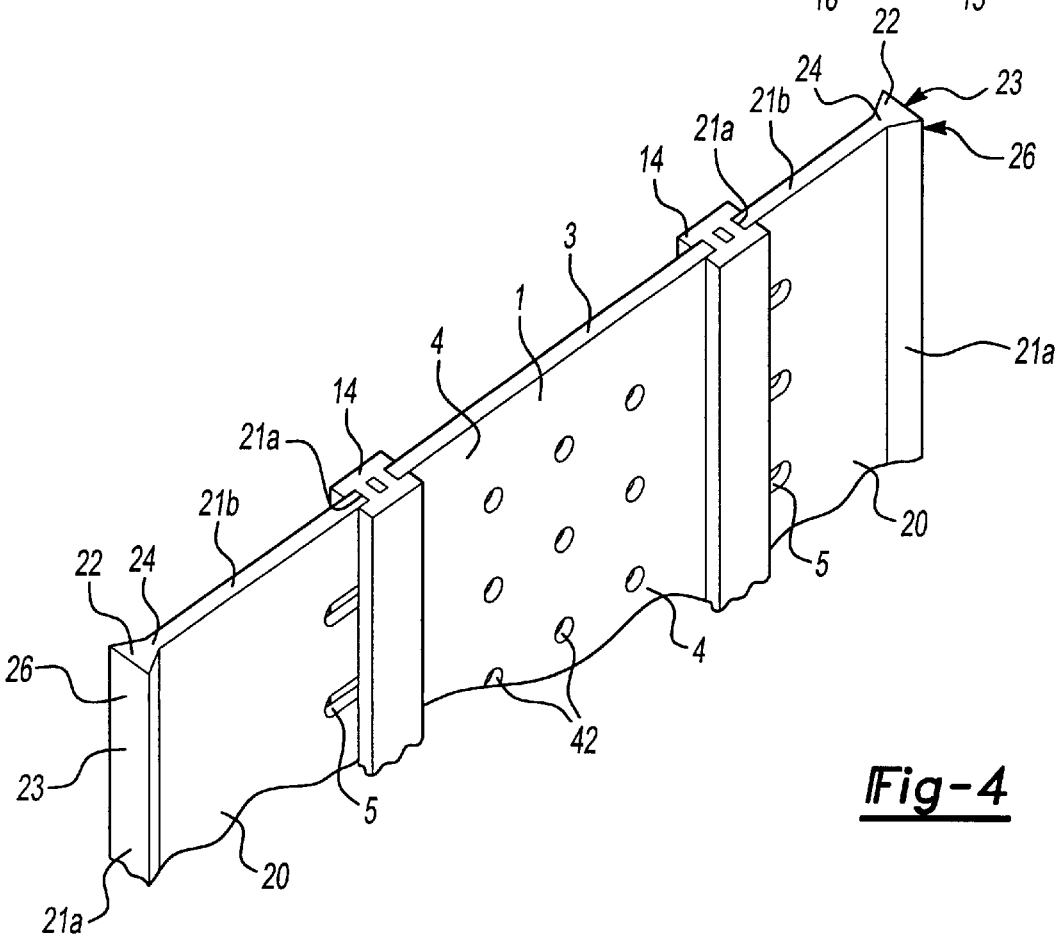

FIGS. 3*a* to 3*c* each show an end view of a connecting element; and

FIGS. 4 to 13 each show an end region of a shuttering element according to the invention.

Figure 1:
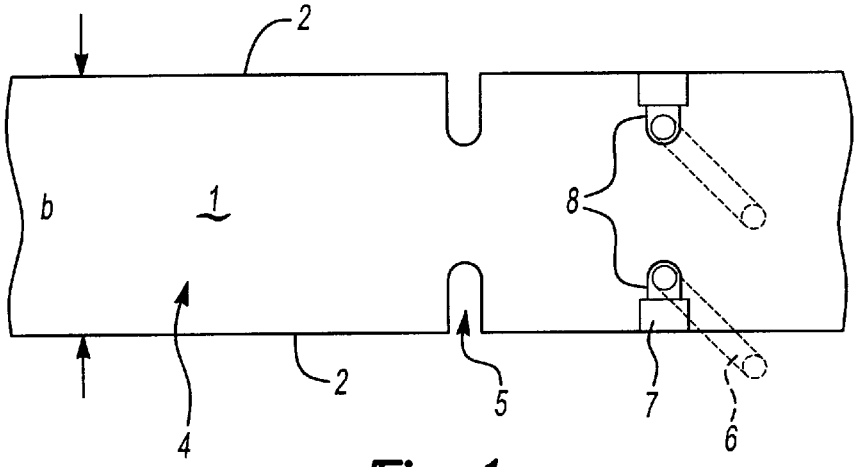
FIG. 1 shows a side view of a region of a shuttering element according to the invention.

FIG. 1 depicts a region of a first exemplary embodiment of a shuttering element according to the invention.

This shuttering element is formed from a single strip-like, planar joint board 1. The joint board 1 consists of a sheet-like, thin-walled material. Sheet-like means that the joint board 1 is an essentially flat, thin-walled element which, in a manner similar to a thin metal sheet, has a certain inherent rigidity. The joint board 1 is formed from plastic or metal or from some other material which has comparable mechanical properties.

The strip-like joint board 1 has two long longitudinal edges 2 and two short end edges 3, which bound two side surfaces 4. Introduced into the joint board 1 are recesses in the form of slots 5 which open out at the longitudinal edges 2. The slots have reinforcement struts engaging through them, the opening of the slots 5 being closed by a covering element 7, with the result that only a narrow gap 8 remains between the reinforcement struts 6 and the joint board 1. The covering element 7 may comprise a plastic plate which is provided with latching arms in order to be secured in a latching manner on the joint board 1. However, it is also possible for merely an adhesive tape to be provided as the covering element 7.

When shuttering is being set up, the shutting element, according to the invention, is inserted into a main shuttering as a separating shuttering, with the result that the main shuttering is subdivided into a plurality of subregions. In this case, the shuttering board 1 is introduced approximately horizontally between the reinforcement struts 6 and rotated into a vertical position, with the result that the reinforcement struts 6 pass through the slots 5. The slots 5 are then closed off by the covering elements 7, with the result that the reinforcement struts 6 and the shuttering board 1 only have a narrow gap 8 remaining between them through which only extremely small quantities of fluid concrete can pass during the casting operation. The shuttering board 1 is fixed in a known manner by supporting elements and/or fastened on the reinforcement. Fixing the shuttering board 1 completes the task of setting up the shuttering.

Once the shuttering has been set up, it is filled with fluid concrete. All the subsections can be cast with concrete at the same time, with the result that the concrete section as a whole can be cast in a single concrete operation. The fluid concrete is then smoothed off by a stripper, the top edge of the shuttering element serving as stripper and easily allowing even, uniform distribution of the fluid concrete.

The shuttering element according to the invention can be inserted into the main shuttering and fixed therein, easily and very quickly. This saves a considerable amount of time in comparison with the conventional separating shuttering.

Since the shuttering elements according to the invention are aligned with the surface of the concrete subsections and are formed from a sheet-like material, they do not have to be removed, with the result that the concrete section as a whole can be cast in a single concreting operation. This achieves a considerable time-related advantage in comparison with the conventional casting process, in the case of which the individual concrete subsections are cast in a number of operations.

The shuttering board 1 according to the invention is cut, on the customer's request, from large-surface-area plastic panels at the factory by the manufacturer of the shuttering elements. The shuttering board 1 is cut with a width "b" which corresponds to the thickness of the concrete section. The slots 5 are milled into the shuttering board 1 in accordance with the customer's instructions. The arrangement of the slots 5 corresponds to the arrangement of the reinforcement struts, which are often arranged at the same conventional intervals. For such standard arrangements of the slots 5, it is also possible for the shuttering board 1 according to the invention to be produced in conventional widths irrespective of the customer.

Figure 2:
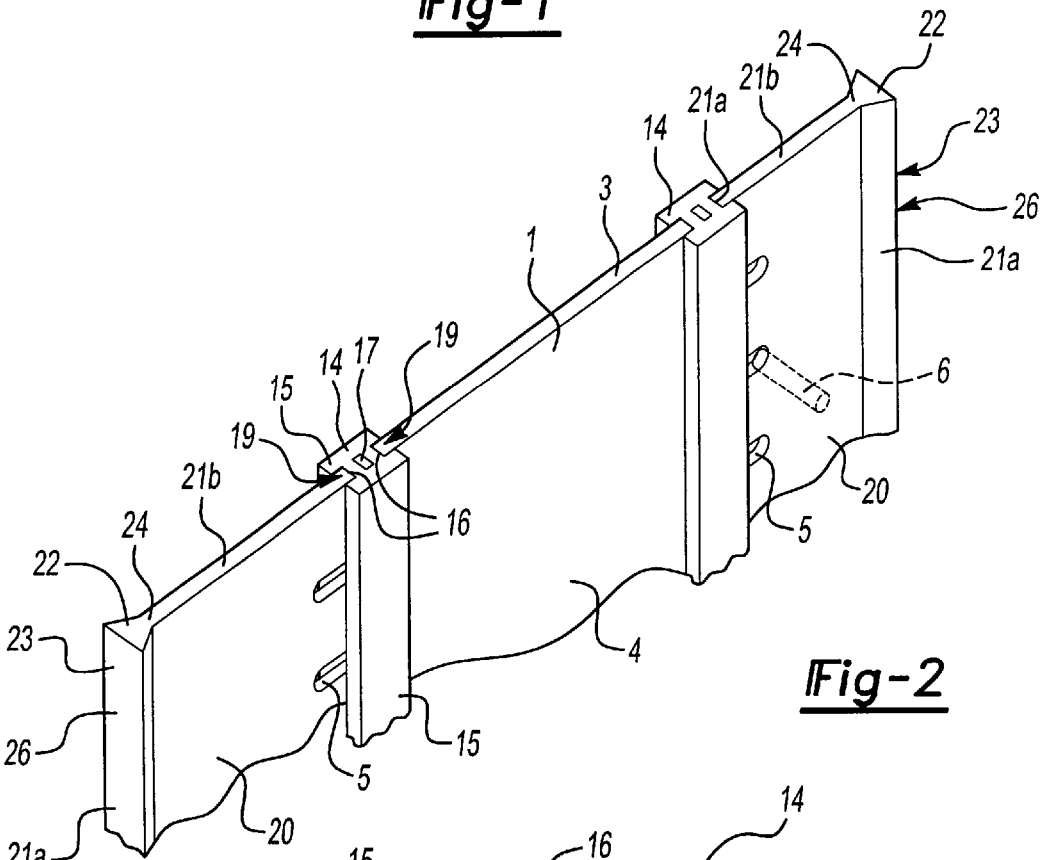
FIG. 2 shows a perspective view of an end region of a shuttering element according to the invention.

FIG. 2 shows an end region of a second exemplary embodiment of a shuttering element according to the invention.

In this exemplary embodiment, a connecting element 14 is arranged on each of the two longitudinal edges of the shuttering board 1. The connecting element 14 is an elongate plastic or metal profile which has an approximately H-shaped cross section with two side walls 15 and two short connecting webs 16 which are arranged in the central region of the side walls 15 and extend between the side walls 15 at a small distance from one another, thus forming a small channel 17 between the connecting webs 16 and the side walls 15.

On that side of the connecting webs 16 which is directed away from the channel 17, in each case one of the connecting webs 16 and the side walls 15 bound a U-shaped recess 19 for receiving the shuttering board 1 in the region of its longitudinal edge or for receiving a further shuttering board 20 in the region of its longitudinal edge.

The exemplary embodiment depicted in FIG. 2 has a total of three shuttering boards 1, 20 which are assembled by two connecting elements 14 to yield a shuttering element. Hereinbelow, the central shuttering board 1 is referred to as a "basic shuttering board" 1 and the two shuttering boards 20, which are fitted laterally onto the basic shuttering board 1, are referred to as "add-on shuttering boards" 20.

The add-on shuttering board 20 is a flat element which, in the same way as the basic shuttering board 1, is preferably formed from a sheet-like and thus inherently rigid plastic or metal strip. The add-on shuttering board 20 has two long longitudinal edges 21*a* and two short end edges 21*b*. The add-on shuttering board 20 is inserted into one of the recesses 19 of the connecting element 14 by way of a longitudinal edge 21*a*. A triangular strip 22 is formed on that side edge 21*a* of the add-on shuttering board 20 which is located opposite the connecting element 14. The triangular strip 22, in cross section, is in the form of an essentially equilateral triangle and is formed integrally on the add-on shuttering board 20, the triangular strip 22 having a triangular base surface 23 arranged in the outward direction and being attached to the add-on shuttering board 20 by way of its apex 24, which is located opposite the triangle base surface 23. The triangle base surface 23 of the triangular strip 22 is arranged transversely to the defining plane of the add-on shuttering board 20. Introduced in the region of that longitudinal edge 21*a* of the add-on shuttering board 20 which is inserted into the connecting element 14 are slots 5 which run perpendicularly to the longitudinal edge 21*a* and can have passing through them a reinforcement of a concrete section which is to be produced.

The shuttering element divided up into a plurality of shuttering boards 1, 20 can be very easily inserted into a main shuttering as a separating shuttering, even if reinforcement struts are to cross the separating shuttering.

The basic shuttering board 1 is introduced, with the connecting elements 14 fitted on it, between the reinforcement struts 6, and the add-on shuttering boards 20 are fitted onto the basic shuttering board 1. The slots 5 of the add-on shuttering board 20 are closed off on their open side by the connecting element 14 and, together with the connecting element 14, enclose in each case one reinforcement strut 6. The width of the basic shuttering board 1 is thus somewhat smaller than the distance between a top reinforcement strut and bottom reinforcement strut of a reinforcement, and the width of the ad-on shuttering board 20 corresponds to the amount by which the concrete section covers the reinforcement.

The shuttering element, according to the invention, thus means that the operation which, up until now, involved very high outlay of adapting the separating shuttering to the reinforcement struts is reduced merely to the action of the basic shuttering board 1 and the add-on shuttering board 20 being fitted together.

The add-one shuttering boards 20 form, by way of their triangle base surfaces 23, in each case an outer boundary edge 26 of the shuttering element. However, the invention is not restricted to a shuttering element with two or more add-one shuttering boards 20; also within the scope of the invention is an embodiment in which a shuttering element is made up of a single basic shuttering board 1 and a single add-on shuttering board 20.

As is shown in FIG. 2, the connecting element 14 may comprise an H-shaped profile into which in each case one basic shuttering board 1 and one add-on shuttering board 20 are inserted and secured by frictional locking.

In order to increase the retaining force, the H-shaped profile may be provided, on the inner surfaces of the side walls 15, with an oblique toothing arrangement 27 (FIG. 3*a*). The teeth 27*a* of the oblique toothing arrangement 27 each have a flank 28, which rises up obliquely in the direction of the connecting web 16 from the inner surfaces of the side wall 15, and a flank 29, which drops down vertically to the side wall 15, with the result that the teeth 27*a* dig into an inserted shuttering board 1, 20 in the manner of barbs.

In a further embodiment, the connecting element 14 is formed from a screw clamp 30 which has two strip-like plates 31 (FIG. 3*b*). Introduced transversely in the center of the plates 31, opposite one another, are holes through which there engage screws 32 which are each secured by a nut 33. The plates 31 are each provided, on their mutually opposite surface, transversely in the center with a platform-like profile web 34 of the same width. These profile webs 34 have longitudinal edges 35 which serve as stops for the introduction of the basic shuttering board 1 or of the add-on shuttering board 20 into the interspace between the plates 31. Spikes 36 are formed on the mutually opposite surfaces of the plates 31, and are arranged in a laterally offset manner in relation to the profile webs 34.

Said screw clamp 30 can be used to connect a basic shuttering board 1 to an add-on shuttering board 20 in that the basic shuttering board 1 and the add-on shuttering board 20 are introduced, by way of their longitudinal edges, into the interspace between the strip-like plates 31 in each case as far as a longitudinal edge 35 of the profile webs 34, it then being the case that by tightening the screw-connections, comprising the screw 32 and the nuts 33, the shuttering boards 1, 20 are clamped by the plates 31 and the spikes 36 are driven into the shuttering boards 1, 20.

FIG. 3*c* illustrates an embodiment of the connecting element 14 which is designed as a welding element 40. The welding element 40 has a cross-sectionally H-shaped profile with two side walls 15 and a connecting web 16, with the result that two U-shaped recesses 19 are formed on the connecting element 14. The welding element 40 is formed from plastic. In each case one plastic welding wire 41 for plastic welding purposes is arranged in the U-shaped recesses 19. A plastic shuttering board 1, 20 may be welded to the welding element 40 by a plastic welding process known per se, for example ultrasonic welding. This produces a high-strength connection between the basic shuttering board 1 and the add-on shuttering board 20.

In a further embodiment of the shuttering element according to the invention, the basic shuttering board 1 has holes 42 (FIG. 4), which are introduced at regular intervals in the basic shuttering board 1 and form perforations. Such a perforated basic shuttering board 1 is preferably used in the case of viscous concrete. The diameter of the holes 42 is selected such that only extremely small quantities of fluid concrete pass through, harden and form small spherical protrusions on the shuttering element. The shuttering element is anchored on the concrete subsection by the concrete which passes through the holes 42 and hardens. The spherical protrusions are anchored in the subsequently concreted concrete subsection, with the result that transverse forces can be transmitted at the joint between the two concrete subsections. If the two concrete subsections are cast at the same time, the two concrete subsections may undergo mineralogical bonding with one another in the region of the holes.

Figure 5:
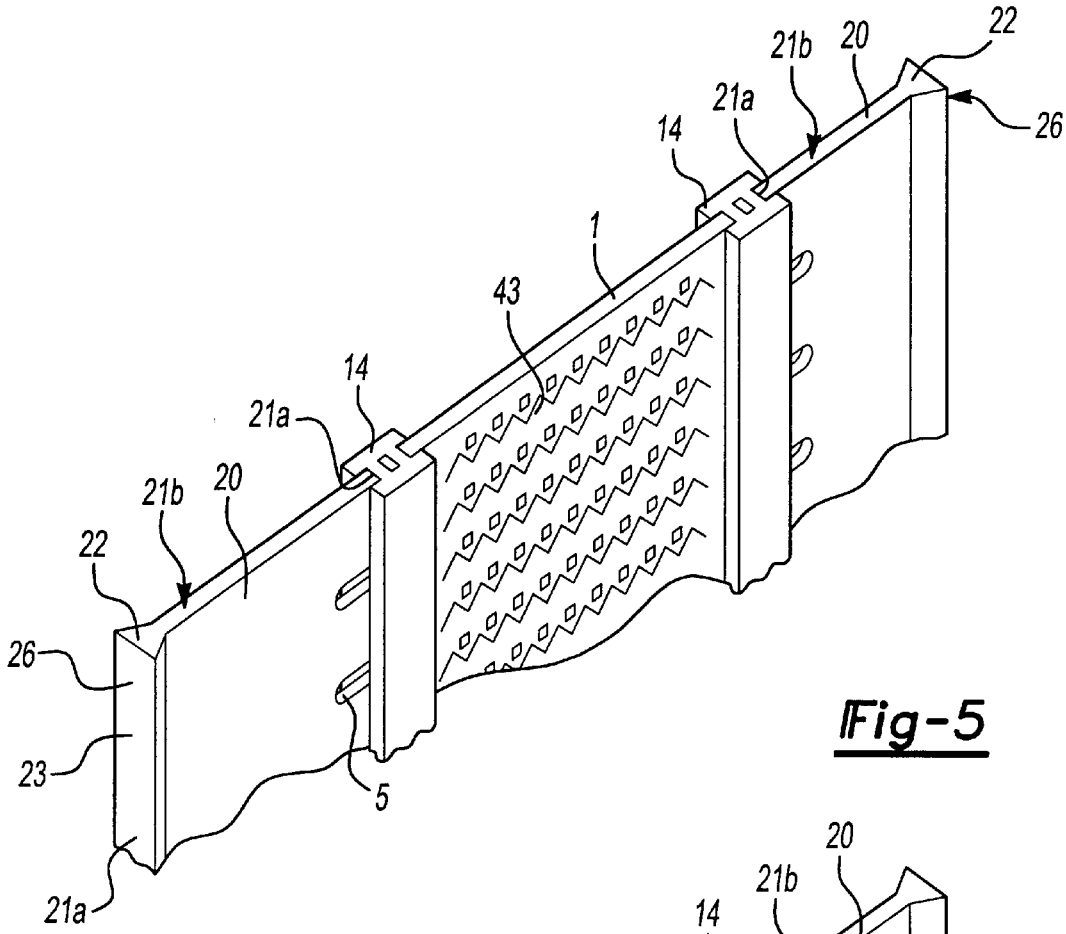

In a functionally similar embodiment, the basic shuttering board 1 is formed from expanded metal 43 (FIG. 5). Expanded metal has a ribbed structure with a multiplicity of small holes. The concrete which is to be case is usually of such a viscosity that it does not pass through the holes of the expanded metal. Accordingly, the highly contoured surface structure of the expanded metal 43 results in the formation of contoured and interengaging end surfaces on the two concrete subsections. By virtue of these interengaging end surfaces, transverse forces can be transmitted in the region of the joint formed between the concrete subsections.

Figure 6:
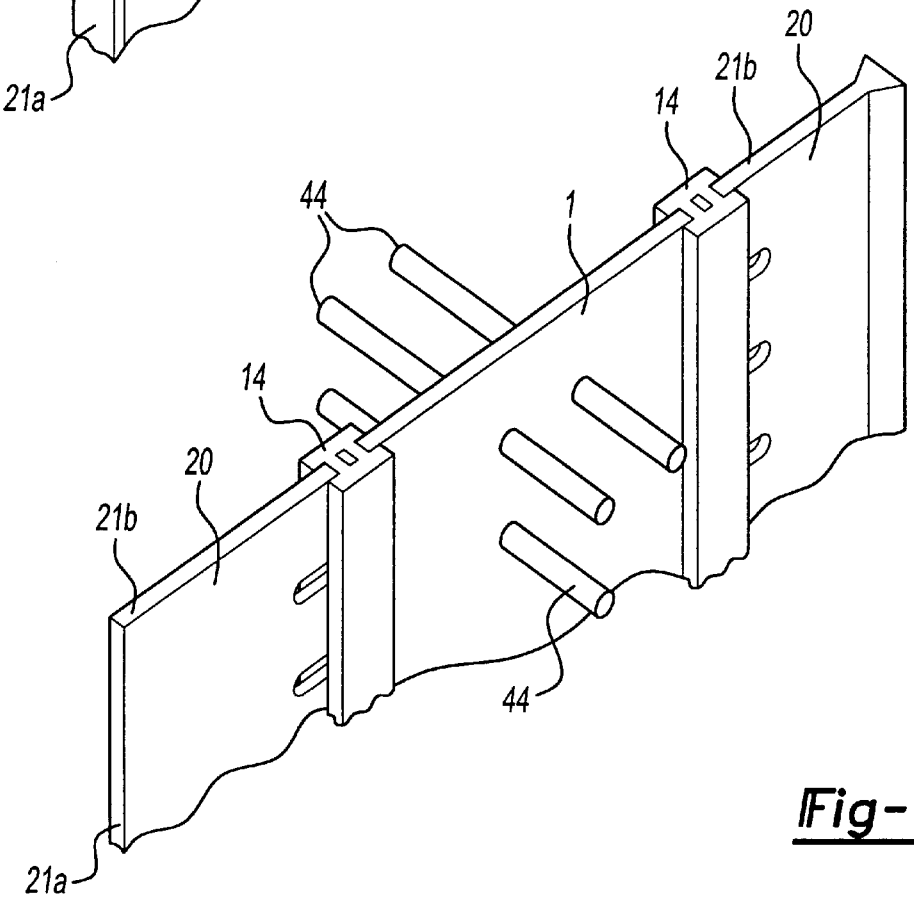

A shuttering element with a further anchoring means is illustrated in FIG. 6. This shuttering element has a basic shuttering board 1 which has transverse pegs 44 passing through it. The transverse pegs 44 are steel rods with a circular cross section and a thickness of from 1–2 cm. The transverse pegs 44 are arranged with their longitudinal extent transverse to the defining plane of the basic shuttering board 1 and project from the side surfaces 4 of the basic shuttering board 1 by a length of from 10–20 cm.

Figure 7:
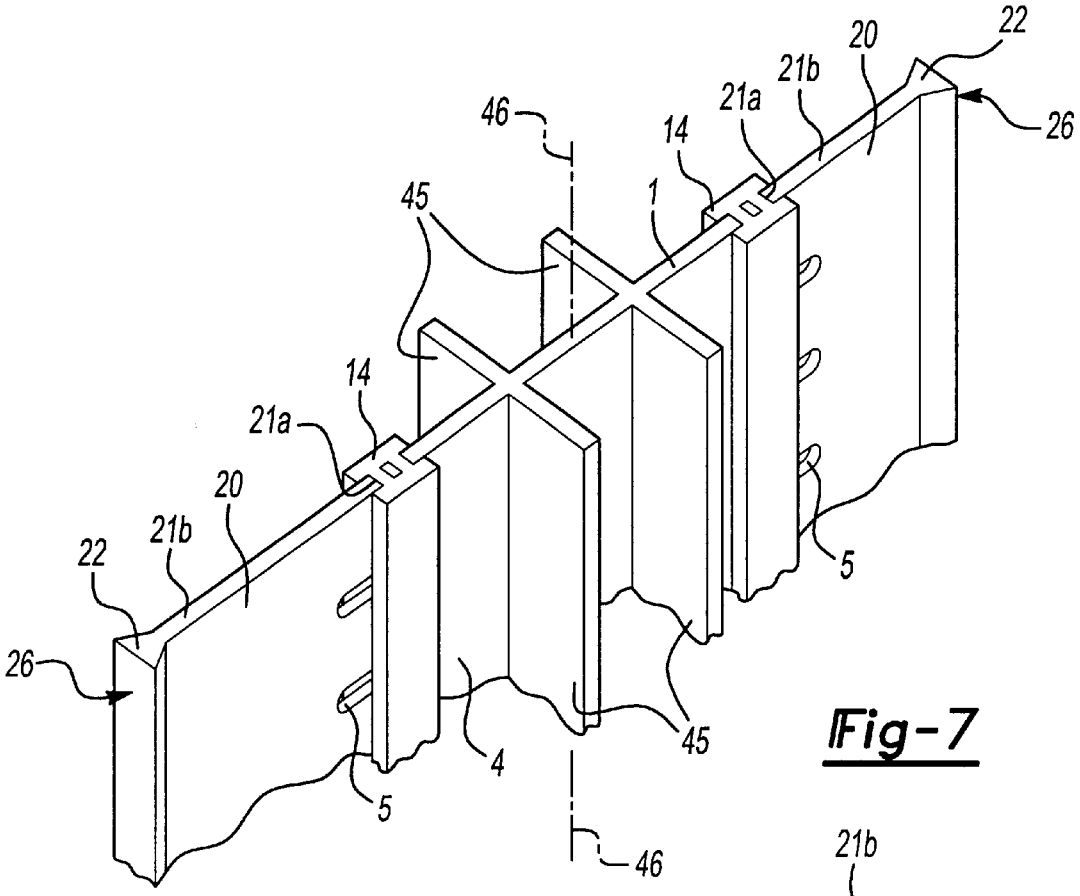
Figure 8:
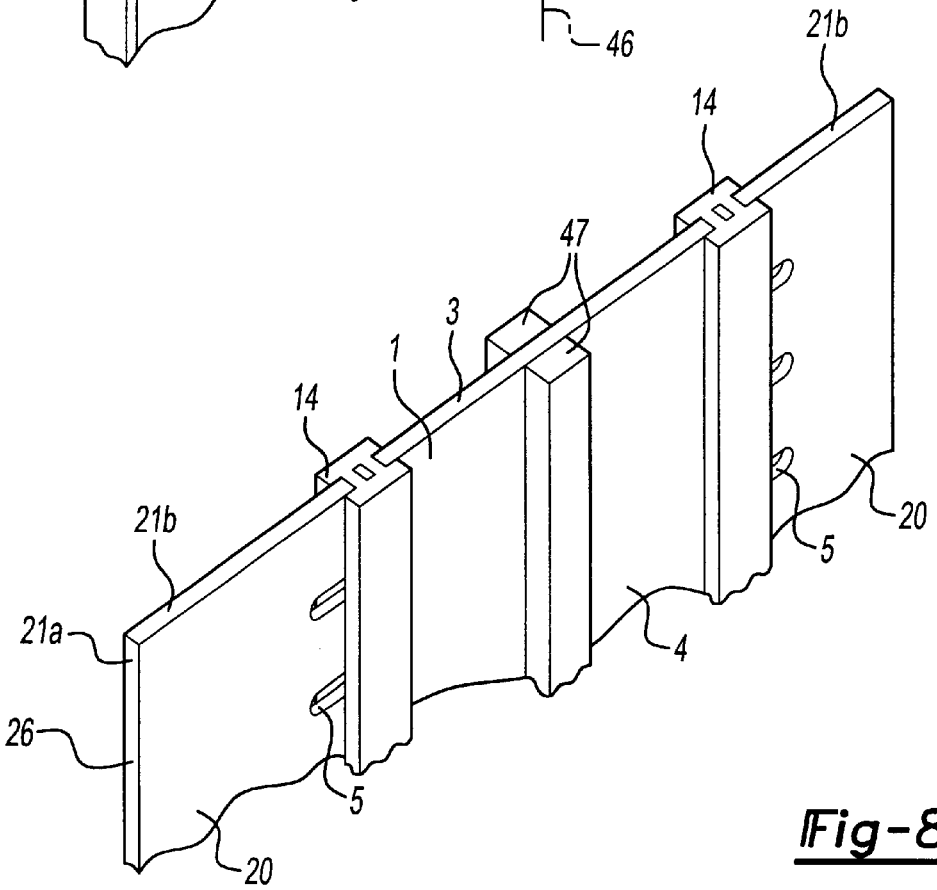

A further embodiment of the invention has a basic shuttering board 1 with transverse webs 45 (FIG. 7). The transverse webs 45 are formed integrally on the basic shuttering board 1, the transverse webs 45 being aligned in the longitudinal direction of the basic shuttering board 1 and projecting perpendicularly from the side surfaces 4 of the basic shuttering board 1. In the case of the exemplary embodiment illustrated in FIG. 6, two transverse webs 45 are arranged, on each side surface 4, in a mirror-symmetrical manner about a central longitudinal axis 45 of the basic shuttering board 1. The transverse webs 45 increase the interface between the shuttering element and the concrete subsections, and in particular the interface between the basic shuttering board 1 and the concrete subsections, and extend the so-called water path between the shuttering element and the concrete subsections, thus resulting in improved sealing of the joints formed between the two concrete subsections by the shuttering element according to the invention.

The number and the size of the transverse webs 45 can be varied as required. The more pronounced the fluid pressure acting on the joint is, then the greater should be the number or the dimensions of the transverse webs 45.

In a further embodiment (FIG. 8), expanding strips 47 are arranged in the longitudinal direction on the basic shuttering board 1 in order to increase the sealing. The expanding strips 47 are preferably arranged transversely in the center of the side surfaces 4 of the basic shuttering board 1. Such expanding strips expand under the influence of water. The expanding agent is a hydrophilic compound which is embedded in a carrier material, usually chloroprene rubber. The carrier material has, in particular, the task of giving stability and elasticity to the expanding agent. The hydrophilic (water-absorbing) component takes up water molecules and thus increases its volume 1.5-fold to approximately 4-fold. This seals the joint formed between the two concrete subsections.

Figure 9:
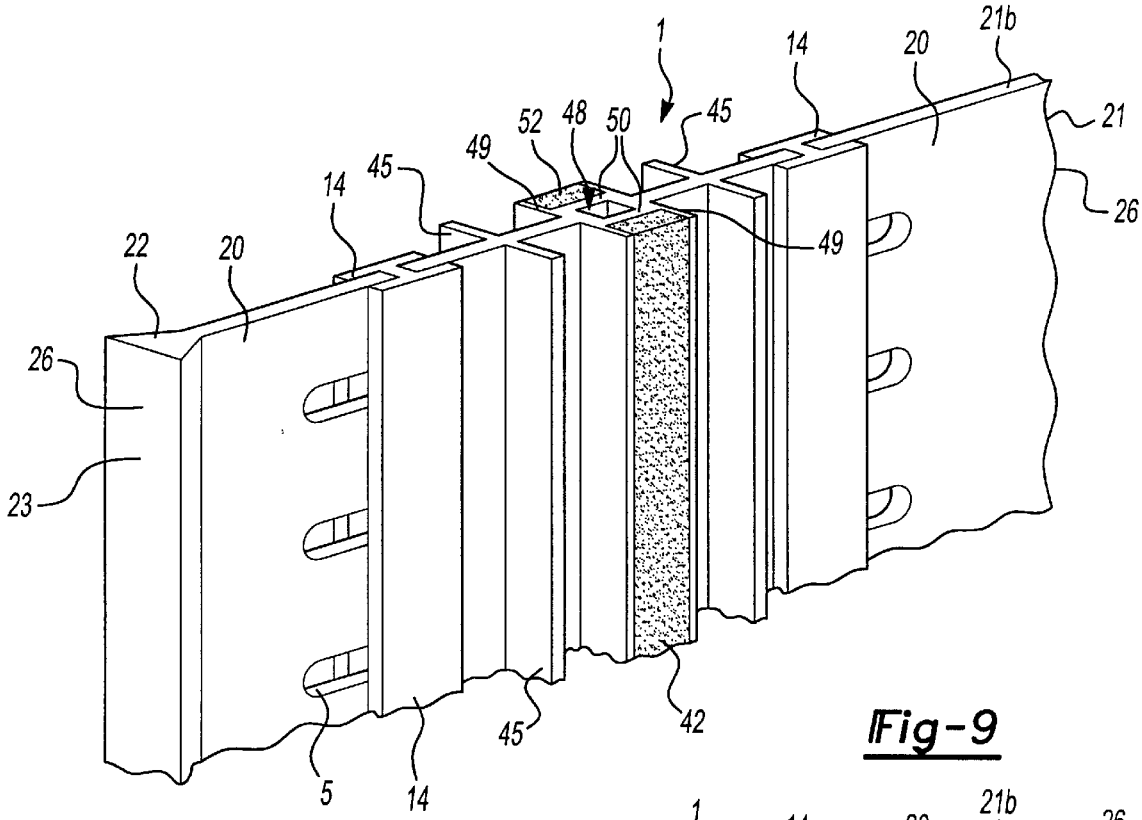

A preferred embodiment of the invention has a basic shuttering board 1 with an injection channel 48 which allows subsequent sealing of the joint between two concrete subsections by sealing material being forced into gaps in the joint region (FIG. 9).

The integrally formed injection channel 48 is bounded by in each case two transverse walls 49, which are arranged perpendicularly to the basic shuttering board 1, and two side walls 50, which are arranged parallel to the defining plane of the basic shuttering board 1. The side walls 50 are arranged in a laterally offset manner in relation to the defining plane of the basic shuttering board 1 and are spaced apart from one another, for example, by the thickness of the basic shuttering board 1. The walls 49, 50 thus form the hollow, cross-sectionally rectangular injection channel 48.

Holes (not illustrated) are introduced at regular intervals in the side walls 50. The transverse walls 49 are extended laterally beyond the side walls 50, with the result that cross-sectionally U-shaped recesses or grooves are formed on those sides of the side walls 50 which are directed away from the injection channel 48. Said grooves each have an open-cell foam strip 52 arranged in them, said strip filling the U-shaped recess.

The joint between two concrete subsections can be sealed subsequently by way of the injection channel 48 in that sealing material is injected under pressure into the injection channel 48 and the sealing material passes, through the holes in the side walls 50, into the foam strips 52 which then fill with the sealing material and thus form a further channel section which runs parallel to the injection channel 48 and is intended for receiving and for distributing the sealing material.

The size of the cells of the open-cell foam strip 52 is selected such that, during concrete, no concrete penetrates into the injection channel 48. However, the foam strips 52 are permeable for the sealing material injected under pressure into the injection channel 48, with the result that the sealing material can spread outward into an undesired cavity and fill the latter in a sealing manner. As far as the rest of the injection operation with sealing material is concerned, you are referred to the prior art, in particular to EP 09 418 699 A1.

Figure 10:
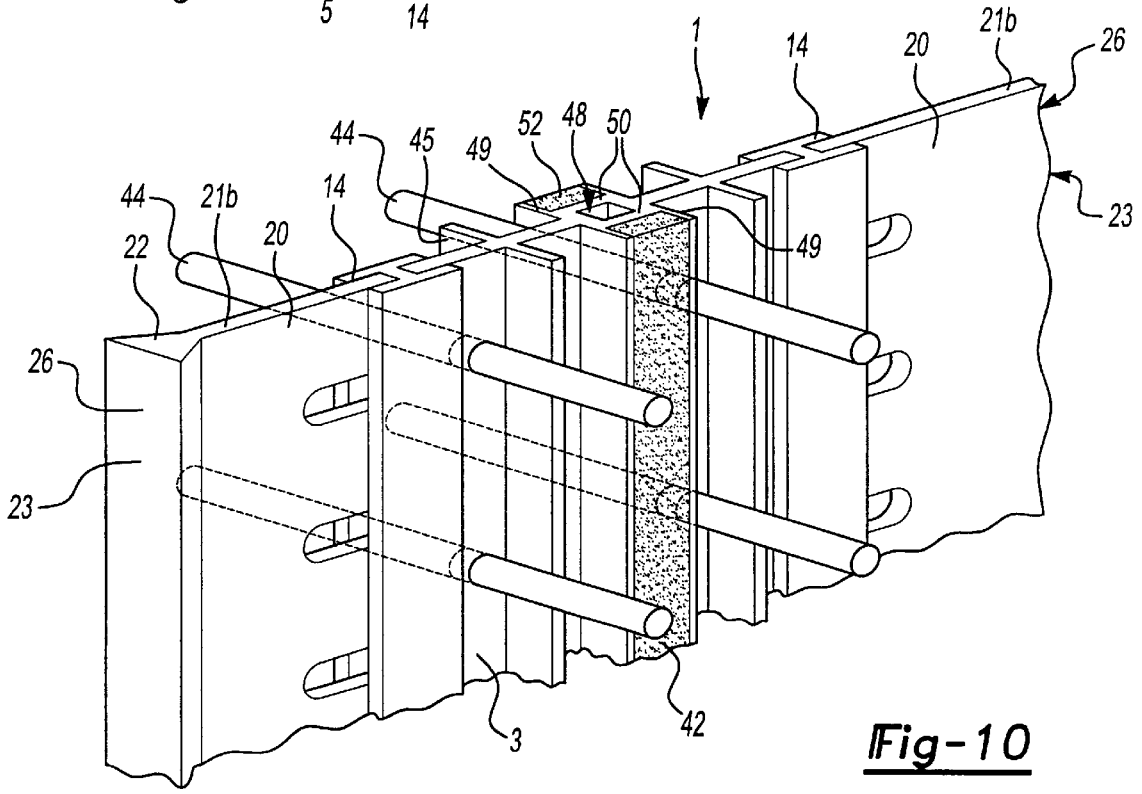

The injection channel 48 is preferably combined with the water-path-extending transverse webs 45, with the result that it is possible to ensure extreme requirements to be met by the sealing of the joint formed between two concrete subsections. It is additionally possible for the transverse pegs 44 already mentioned above to be provided on the basic shuttering board 1 (FIG. 10).

Figure 11:
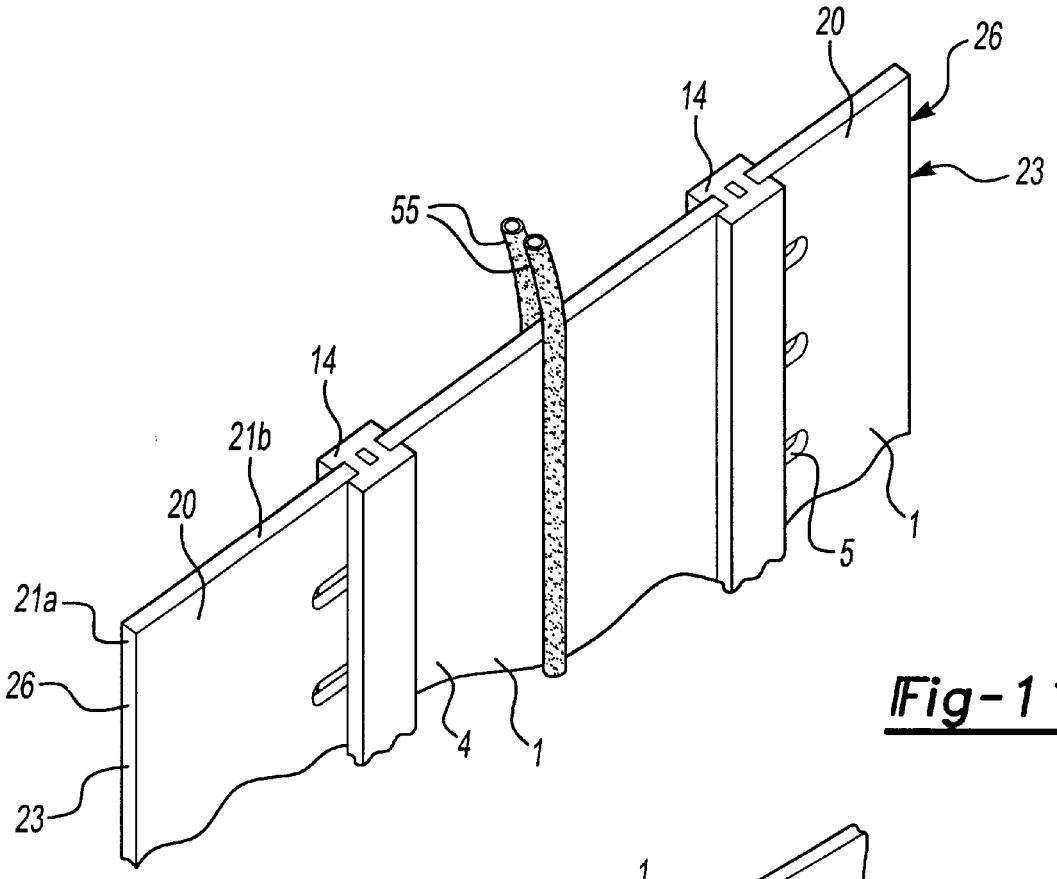

For subsequent sealing of the joints between two concrete subsections, it is also possible for the shuttering element according to the invention to be provided with an injection tube 55 which is known per se (FIG. 11). Such an injection tube is described, for example, in CH Patent 600 077. It is preferable for in each case one injection tube 55 to be arranged transversely in the center of the two side surfaces 13 of the basic shuttering board 1.

Figure 12:
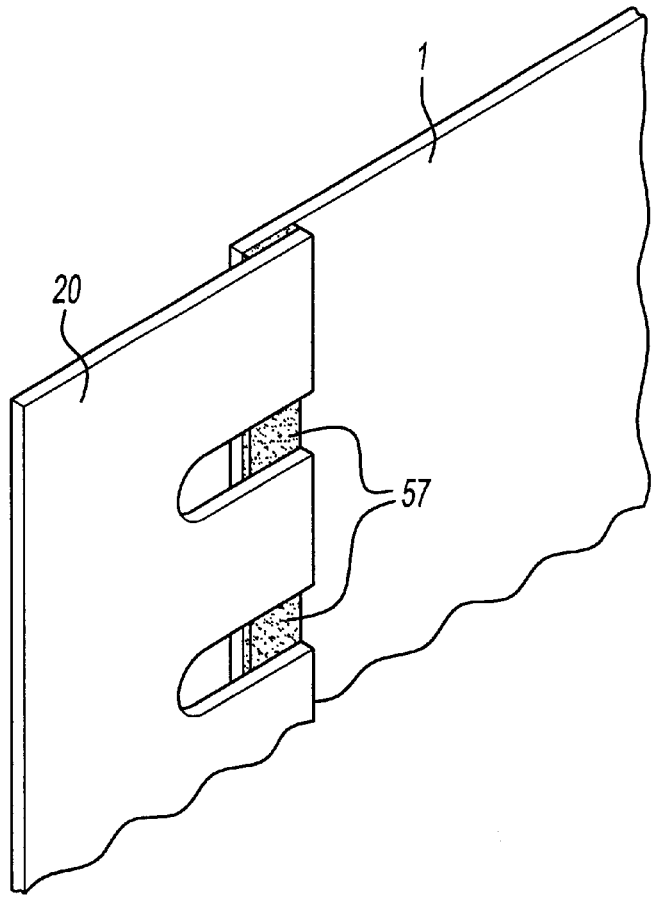
Figure 13:
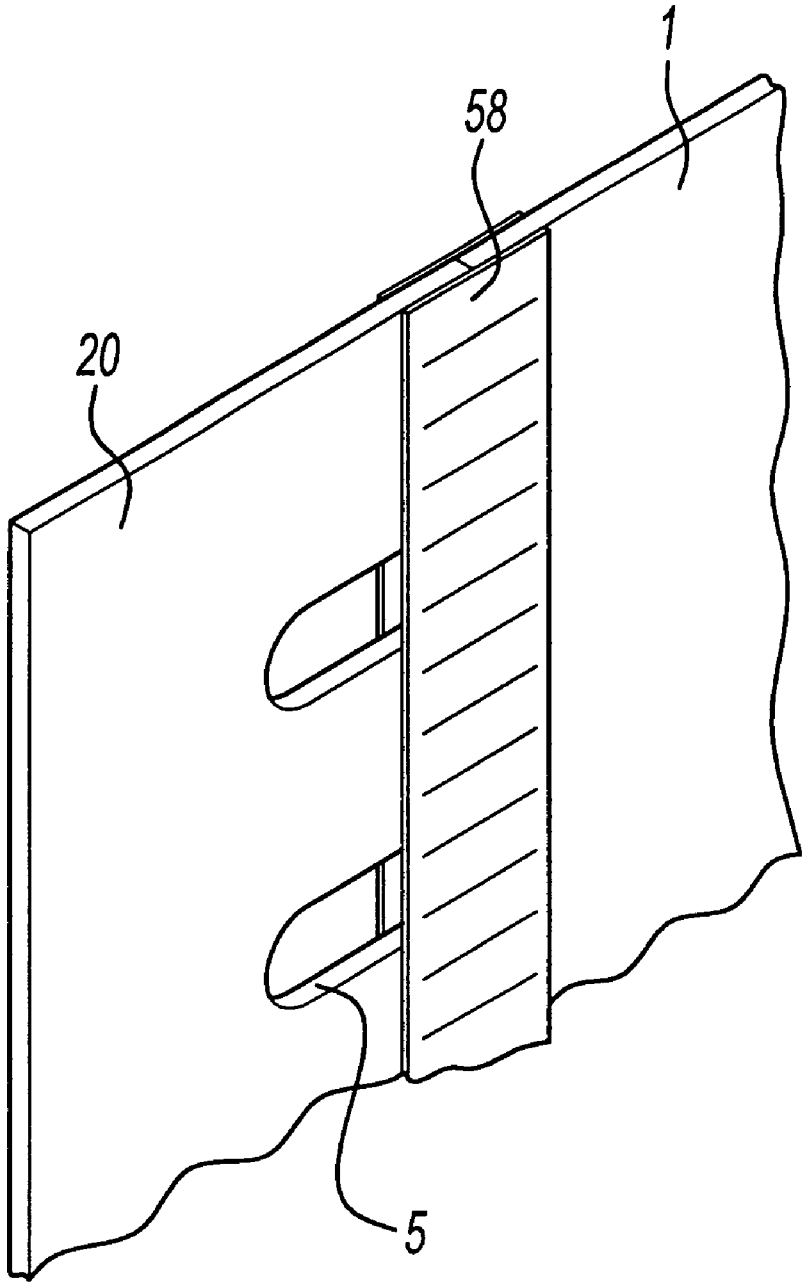

In a further embodiment of the invention, the basic shuttering board 1 and the add-on shuttering board 20 are connected to one another by adhesive bonding (FIGS. 12, 13).

The basic shuttering board 1 and the add-on shuttering board 20 are joined to one another such that they overlap in the region of their longitudinal edges, there being introduced between the basic shuttering board 1 and the add-on shuttering board 20 an adhesive layer 57 which connects the basic shuttering board 1 and the add-on shuttering board 20. The adhesive layer 57 may be applied as a double-sided adhesive tape or as a hot-melt adhesive layer.

The basic shuttering board 1 and the add-on shuttering board 20 are formed from plastic, metal or cardboard or stiff paperboard. Cardboard is preferably used when the shuttering element is intended to be removed once a first concrete subsection has been concreted. It may also be expedient merely for the add-on shuttering board 20 to be formed from cardboard and to be used in conjunction with adhesive bonding between the add-on shuttering board 20 and the basic shuttering board 1. This is particularly advantageous if it is intended that the add-on shuttering board (20) will be removed after the first concrete subsection has been formed. In that case all that is required is for said shuttering board to be drawn off from the location of the adhesive bonding with the basic shuttering board 1.

Instead of the overlapping arrangement of the basic shuttering board 1 and add-on shuttering board 20, these may also be arranged with their longitudinal edges in abutment and be adhesively bonded to one another by a single-sided adhesive tape 58 in the region of their abutment joint (FIG. 13). The adhesive tape may be arranged on one side or both sides of the shuttering element.

Rivets can be used as a further connecting element for connecting the two shuttering boards 1, 20. For this purpose, the shuttering boards 1, 20 are provided at regular intervals with rivet holes, which are introduced, for example, using a template. During assembly, the shuttering boards 1, 20 are retained against one another such that the rivet holes are aligned with one another and are fastened on one another by rivets inserted through the holes. Use is preferably made of blind rivets, which can be manipulated from one side by a corresponding tool.

Dividing the shuttering element up into a basic shuttering board 1 and one or more add-on shuttering boards 20 makes it possible to use a standard-width shuttering board which is configured in a relatively complex manner with one or more functional elements and can be produced cost-effectively in large numbers. The basic shuttering board is adapted to the thickness of the concrete section by means of the add-on shuttering boards 20, which are of relatively simple configuration. The slots 5 for the reinforcement struts 6 are preferably introduced in the add-on shuttering board 20, with the result that the add-on shuttering boards 20 adapt the shuttering element individually to the concrete section which is to be produced. By virtue of the combination of the different shuttering elements, it is therefore possible to provide a cost-effective, multifunctional and nevertheless individually adapted shuttering element.

The use of the shuttering element according to the invention on a building site is explained hereinbelow.

On the building site, the shutterings for the concrete sections which are to be produced are erected from shuttering panels in a manner well-known. The shuttering element according to the invention is inserted as a separating shuttering into said shutterings which are known per se, with the result that a concrete section which is to be produced is subdivided into at least two subsections.

In the case of a horizontal concrete section, the shuttering element according to the invention is positioned in a tray-like main shuttering with one of its boundary edges 26 resting on the tray base, with the result that the shuttering element stands vertically on the tray base. The shuttering element is adapted to the width of the end surface of the concrete section which is to be produced, with the result that the shuttering element extends vertically, by way of its boundary edges 26, from the bottom edge to the top edge of the concrete section which is to be produced. In the horizontal direction, the shuttering element extends between two border regions of the tray-like shuttering, with the result that the tray-like shuttering is subdivided into at least two subregions. Fluid concrete is case in said subregions and, following the hardening operation, forms in each case one concrete subsection. Since the shuttering elements according to the invention do not have to be removed once the concrete subsections have been formed, and it is not necessary to wait for a concrete subsection to harden until the shuttering element can be removed, the concrete subsections can be cast at the same time or with just a short period of time between them.

In the case of a vertical concrete section, the main shuttering forms a narrow, elongate box with two mutually opposite, vertical, large-surface-area side surfaces which are spaced apart from one another by the thickness of the concrete section which is to be concreted. The shuttering element according to the invention, which is adapted to the thickness of the concrete section which is to be produced, is inserted vertically between said two large-surface-area side surfaces, with the result that it terminates flush, by way of its boundary edges 26, with the inner surfaces of the box-like shuttering. Once again, the shuttering is thus subdivided into at least two subregions, which are each filled with fluid concrete to yield concrete subsections. It is thus also possible to use the shuttering element according to the invention. in vertical concrete sections, to form construction joints between concrete subsections since the shuttering element according to the invention an easily be adapted to the thickness of the concrete section and inserted into a corresponding shuttering.

What is claimed is:

1. A shuttering element for separating a concrete section into subsections, the shuttering element adapted to remain between the subsections and corresponding widthwise to the thickness of the concrete section, wherein said shuttering element comprises a board which has two longitudinal edges and is made of a thin-walled, sheet material, it being the case that the board has recesses through which reinforcement struts can engage, and the recesses are defined as slots which are arranged on at least one of said longitudinal edges and a covering element covering at least a portion of the slots, said covering element comprising a plastic plate having latching arms, said latching arms securing said plastic plate to said board.

2. A concrete form for separating a section of concrete into subsections, wherein said form is adapted to be cast into said section of concrete, said form comprising:

a board having two longitudinal edges, said board comprising a thin-walled, sheet material and a plurality of recesses, said recesses located in at least one of said longitudinal edges; and a plate covering at least a portion of said recesses, said plate comprising latching arms securing said plate to said board.

* * * * *